US005174354A

United States Patent [19]

Neeser et al.

[11] Patent Number: 5,174,354

[45] Date of Patent: Dec. 29, 1992

[54] DELIVERY SYSTEM FOR CARBONATED BEVERAGES

[75] Inventors: Timothy A. Neeser, Savage, Minn.; Martin S. Taylor, Waleska, Ga.

[73] Assignee: Minnesota Valley Engineering, Inc., New Prague, Minn.

[21] Appl. No.: 672,344

[22] Filed: Mar. 20, 1991

[51] Int. Cl.[5] ..... B67C 3/00

[52] U.S. Cl. ..... 141/5; 141/9; 141/18; 141/59; 141/91; 141/92; 141/197; 141/198; 141/35; 141/302; 137/113

[58] Field of Search ..... 141/231, 1, 2, 9, 4, 141/5, 18, 59, 301, 302, 303, 307, 308, 198, 89-91, 92, 382, 197, 35, 325, 326, 383, 387, 327; 137/110-113, 119, 120, 122, 397

[56] References Cited

U.S. PATENT DOCUMENTS

| | | | |
|---|---|---|---|
| 2,872,079 | 2/1959 | Moore | 141/35 X |
| 3,732,902 | 5/1973 | Muller | 141/198 |
| 4,007,766 | 2/1977 | Hurst | 141/98 |
| 4,094,346 | 6/1978 | Milo | 141/286 |
| 4,319,612 | 3/1982 | Golding | 141/1 |
| 4,553,573 | 11/1985 | McGarrah | 141/98 |
| 4,625,778 | 12/1986 | Johnson | 141/301 |
| 4,673,009 | 6/1987 | Giacomazzi et al. | 141/198 |
| 4,974,645 | 12/1990 | Johnson | 141/59 |

*Primary Examiner*—Ernest G. Cusick
*Attorney, Agent, or Firm*—Rockey, Rifkin and Ryther

[57] ABSTRACT

A carbonated beverage delivery system having at least two syrup storage tanks. Each storage tank is provided with a valve that allows air to vent from the tank during delivery, acts as a nozzle to deliver cleaning solution during clean-up operations and, most significantly, meters the amount of fluid delivered to the tank and prevents inadvertent overfill. The tanks are also provided with a syrup feed pipe and drain pipe for filling and discharging the tank, respectively. The drain pipe can be connected to a mixing valve that also receives carbon dioxide and water from separate sources. These components are mixed at the mixing valve to create the desired carbonated beverage which is then delivered to a beverage dispenser. The feed pipe can be connected to a delivery truck supply tank such that its supply of syrup can be replenished. The volume of syrup carried by the truck supply tank is less than the total volume of all the storage tanks to be filled from the supply tank.

18 Claims, 3 Drawing Sheets

DELIVERY SYSTEM FOR CARBONATED BEVERAGES

BACKGROUND OF THE INVENTION

This invention relates, generally, to a system for delivering, storing and dispensing carbonated beverages and, more particularly, to a delivery system that automatically meters the precise amounts of beverage components to be delivered and empties the fill hose after each delivery.

As is well known in the art, a typical carbonated beverage system includes carbon dioxide, syrup and water stored in separate containers. These beverage components are mixed together in the appropriate amounts to produce a desired carbonated beverage. Such beverage systems are typically found in fast food restaurants and other similar establishments where carbonated beverages ar sold in large quantities.

One such beverage system is disclosed in U.S. Pat. No. 4,683,921 issued to Neeser. This system includes two syrup storage tanks means for filling the tanks and a sanitizing unit for periodically cleaning the tanks and the means for filling the tanks. By using two syrup storage tanks, syrup can be dispensed from one tank while the other tank and its filling means are being cleaned and refilled such that the supply of syrup to the beverage dispenser is not interrupted.

While such systems allow for the storage and dispensing of carbonated beverages, there are several disadvantages. The known systems do not provide a reliable method of metering the amount of syrup delivered from the delivery truck to the syrup storage tanks. This disadvantage is significant because syrup suppliers and purchasers are very sensitive to the fact that the amount of syrup delivered is the amount ordered and paid for.

Additionally, the known storage tanks are provided with an open vent to allow air to escape from the tank as the syrup is delivered. One problem with such an open vent is that if the tank is inadvertently overfilled, the syrup can spill from the tank via the vent. Such spillage causes extra cleanup and waste.

Finally, with the known delivery systems the fill hose remains filled with syrup after the storage tank is filled. Because of the weight of the syrup, the full fill hose is very difficult to maneuver.

Thus, a carbonated beverage system that can automatically meter the amount of syrup delivered to the storage tanks to thereby prevent overfill and spillage is desired.

OBJECTS OF THE INVENTION

It is a general object of the invention to provide an improved delivery system for carbonated beverages.

It is another object of the invention to provide an improved delivery system for carbonated beverages that automatically meters the amount of syrup delivered to the syrup storage tanks.

It is a further object of the invention to provide an improved delivery system for carbonated beverages which prevents spillage of the syrup due to inadvertent overfilling of the storage tank.

It is yet another object of the invention to provide an improved delivery system for carbonated beverages that eliminates overfill of the storage tanks.

It is a still further object of the invention to provide an improved delivery system for carbonated beverages in which the syrup in the fill hose can be pumped back into the delivery truck after each delivery.

Other objects of the invention, in addition to those set forth above, will become apparent to one of ordinary skill in the art from the following description of the invention.

SUMMARY OF THE INVENTION

The present invention overcomes the above-noted shortcomings of the prior art and provides a carbonated beverage delivery system having at least two syrup storage tanks. Each storage tank is provided with a valve that: allows air to vent from the tank during delivery; acts as a nozzle to deliver cleaning solution during clean-up operations; and, most significantly, meters the amount of fluid delivered to the tank and prevents inadvertent overfill. The tanks are also provided with a syrup feed pipe and drain pipe for filling and discharging the tank, respectively. The drain pipe can be connected to a mixing valve that also receives carbon dioxide and water from separate sources. These components are mixed at the mixing valve to create the desired carbonated beverage which is then delivered to a beverage dispenser. The feed pipe can be connected to a delivery truck supply tank such that its supply of syrup can be replenished. The syrup remaining in the fill hose can be pumped back into the delivery truck such that the fill hose is in an empty condition after each delivery.

DETAILED DESCRIPTION OF THE INVENTION

Figure 1:
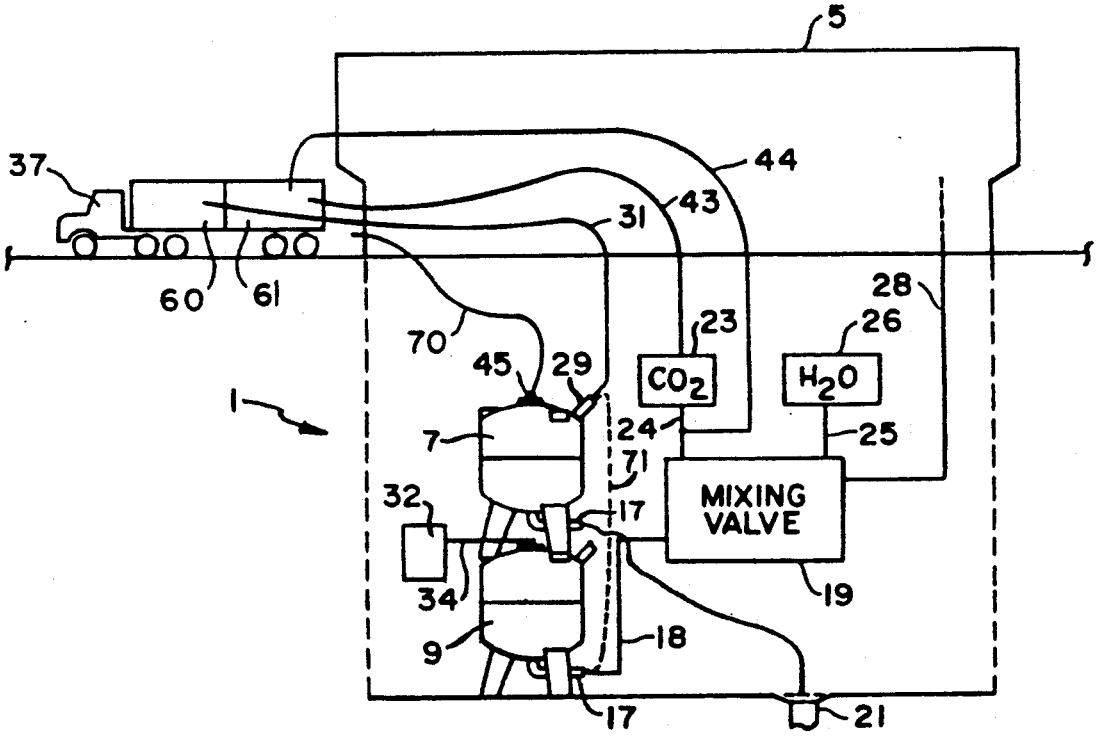
FIG. 1 is a detailed schematic view of the carbonated beverage delivery system of the invention.

The delivery system of the invention is shown schematically at 1 in FIG. 1, located, for example, in the basement of a fast food restaurant 5. The delivery system includes a first storage tank 7 and a second identical storage tank 9 for receiving a supply of syrup.

Figure 2:
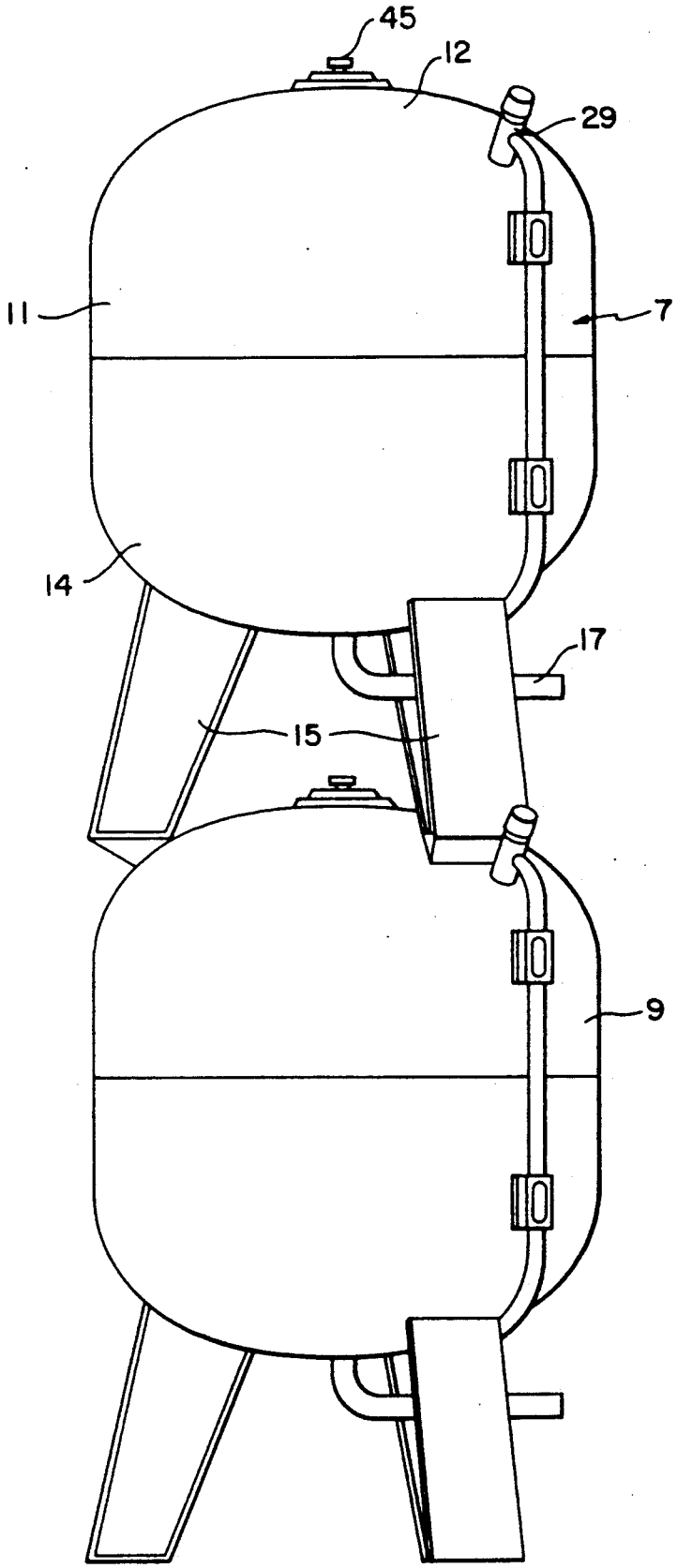
FIG. 2 is an elevation view of the storage tanks of the invention.
Figure 3:
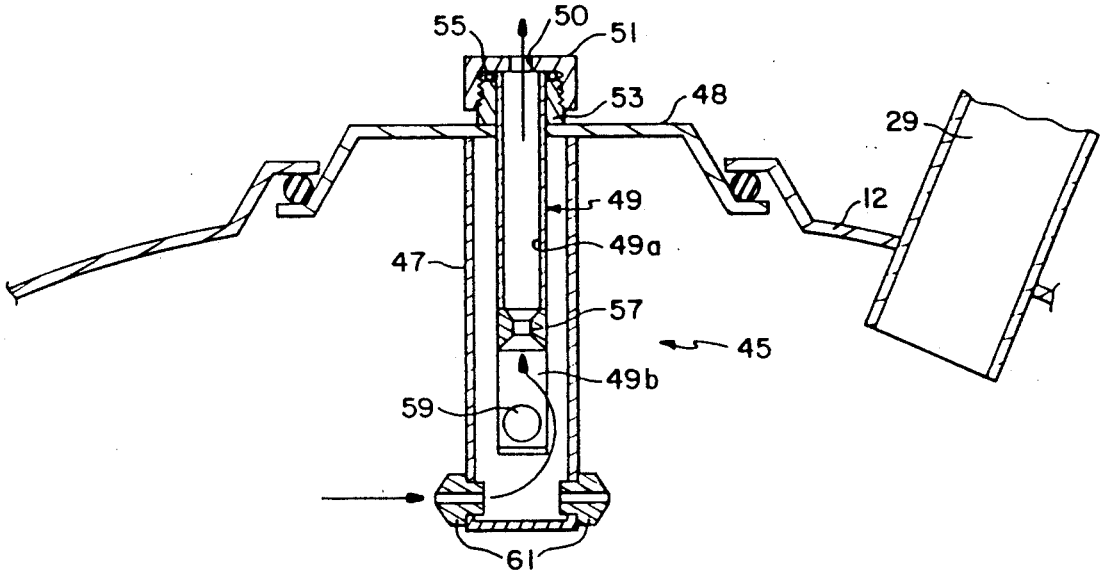
FIG. 3 is a partially cut-away view of one of the storage tanks of FIG. 2 showing the valve of the invention in greater detail.

A more detailed view of storage tanks 7 and 9 is shown in FIGS. 2 and 3. Because storage tanks 7 and 9 are identical to one another, specific reference will be made only to tank 7. Tank 7 consists of a substantially cylindrical side wall 11 integrally formed with a top wall 12 and a bottom wall 14 and is supported on legs 15 in a substantially upright position. Legs 15 and top wall 12 are designed such that the storage tanks can be stacked one on top of the other to save space.

Tank 7 includes a fill pipe 29 located in top wall 12 so that the tank can be connected to fill hose 31 as shown in FIG. 1 for supplying syrup. Tank 7 also includes a drain pipe 17 in its bottom wall 14 for discharging syrup from the tank. Drain pipe 17 can be connected to mixing valve 19 or a drain 21 via supply hose 18 as shown in FIG. 1.

A three-way valve 45 is located in cover 48 of top wall 12 as best shown in FIG. 3. Valve 45 is provided to allow air to vent from tank 7 during the fill-up operation, to spray cleaning fluid into the tank during the clean-up operation, and to act as an automatic metering device to shut-off the flow of syrup during the fill-up operations, as will hereinafter be described.

Valve 45 includes an outer tubular member 47 fixed to cover 48 such that it extends a predetermined distance into tank 7. Located within tubular member 47 is a removable dip tube 49. Dip tube 49 includes a female connector 51 having an aperture 50 that threadably engages with the male threaded member 53 fixed to cover 48. The threadable engagement between connectors 51 and 53 allows dip tube 49 to be removed and replaced. An O-ring seal 55 is provided to prevent leakage between the connectors.

A metal seat 57, formed as a necked-down portion of dip tube 49, is created at a mid point of dip tube 49. Portion 49*a* of dip tube 49, located above seat 57, is a solid member. Portion 49*b* of dip tube 49, located below seat 47, is formed as a wire cage and supports a floatable solid ball 59. A plurality of spray nozzles 61 are supported by the dip tube to clean tanks 7 and 9 as will hereinafter be described To fill storage tank 7, fill line 31 is connected to fill pipe 29 and the discharge pipe 17 is closed. As the syrup enters the tank, the air in the tank is vented to the outside via valve 45 and hose 70. Specifically, the air follows the path, indicated by arrows in FIG. 3, through the spray nozzles 61 into the tubular member 47, then through wire cage 49*b* and valve seat 47 into the dip tube 49 and out aperture 50. Air continues to vacate the tank in this manner until the syrup level rises to that of the spray nozzles 61. When the syrup reaches the nozzles 61, it will enter the tubular member 47 following the path indicated by the arrows in FIG. 3. However, once the syrup level reaches the ball 59, the ball will float on the syrup and be moved toward seat 57 with the rising syrup. When the level of the syrup reaches a point where the ball is firmly seated in valve seat 57, fluid is prevented from exiting tank 7. Thereafter, the syrup will not be able to rise and the flow of syrup into tank 7 will be stopped.

As is evident from the foregoing description of the operation of valve 45, the amount of syrup delivered to tank 7 will be limited by the location of valve seat 57. Thus, valve 45 serves as a mechanism to stop the flow of syrup and in this manner acts as a metering device to precisely control the amount of syrup delivered to any particular tank. Thus, overfilling of the tank is prevented. Moreover, because ball 59 closes vent, it is impossible for the syrup to spill from the vent.

The delivery system of the invention also includes mixing valve 19 for receiving syrup from tanks 7 and 9, carbon dioxide from carbon dioxide tank 23 via line 24, and water from a water source 26 via line 25, as shown in FIG. 1. The syrup, carbon dioxide and water are mixed in appropriate amounts by mixing valve 19 to create the carbonated beverage. The carbonated beverage is delivered from mixing valve 19 to a beverage dispenser in the restaurant 5 via line 28.

A delivery truck 37 for replenishing the delivery system's supply of syrup and carbon dioxide includes supply tanks 60 and 61 containing syrup and carbon dioxide respectively. The delivery truck 37 makes periodic, scheduled deliveries to the restaurant 5 to replenish the restaurant's supplies of syrup and CO2.

In operation, one of the syrup storage tanks, for example, tank 9 is initially filled with syrup and is connected to mixing valve 19 via line 18. Mixing valve 19 also receives carbon dioxide from storage tank 23 and water from source 26. The mixing valve 19 is connected to the beverage dispenser in the restaurant via line 28 such that the syrup supply in tank 9 will be gradually diminished as the carbonated beverage is served. Assume the other syrup supply tank 7 is standing in a clean and empty state.

To fill empty tank 7, line 31 is connected to fill pipe 29 and drain pipe 17 is closed. The delivery truck's syrup supply 60 is connected to the opposite end of line 31 such that syrup is supplied to tank 7. The syrup is forced from supply 60 to tank 7 under a pressure of approximately 60 psi. The syrup can be pressurized either by a source of $CO_2$ on the truck or by connecting the truck to the restaurants $CO_2$ supply via line 44 as shown in FIG. 1. Syrup will continue to be supplied to tank 7, until valve 45 shuts off the supply in the manner previously described. When the supply of syrup to tank 7 is stopped, an equilibrium condition will be established with the air remaining at the very top of tank 7 being compressed to the same pressure as the syrup delivered from tank 60, i.e. the pressure in both the supply tank 60 and storage tank 7 will be 60 psi. In this equilibrium condition the delivery of syrup to tank 7 is stopped even though the fill line 31 remains filled with syrup. To empty fill line 31, the 60 psi pressure is removed from tank 60 and tank 60 vented to the atmosphere. Because of the pressure drop between the interior of tank 7 and vented tank 60, the syrup in fill line 31 will be forced back into tank 60 to thereby empty fill line 31. Note that only the syrup in hose 31 is transferred back to the truck tank 60 because the fill pipe 29 is above the liquid level in tank 7 so there is no siphon effect which would draw off the previously delivered syrup. Because fill line 31 is emptied after each delivery, it is easier to carry and transport. Once the tank is filled, line 31 is disconnected from fill pipe 29. The truck's carbon dioxide supply tank 61 can also be connected to storage tank 23 via line 43 to replenish the supply of carbon dioxide.

In a preferred form of the delivery operation, the truck's syrup supply tank holds slightly less than the total capacity of all the syrup storage tanks to be supplied. For example, if three 25 gallon storage tanks are to be supplied, the truck's supply tank would hold 74 gallons of syrup. As a result, after the three storage tanks were filled, it would be known that exactly 25 gallons were delivered to each of the first two tanks, due to the operation of valve 45, and the remaining 24 gallons were delivered to the last tank. Moreover, the delivery truck's storage tank and supply hose would both be empty. This delivery system eliminates spillage, over and underfilling, and provides an empty full hose after each delivery. Syrup waste is effectively eliminated by using the preferred delivery system in connection with valve 45.

Once most of the syrup in tank 9 has been delivered to mixing valve 19, the supply line 18 is disconnected therefrom and connected to drain pipe 17 of newly filled tank 7 such that the supply of syrup is uninterrupted. A jumper hose 71, is connected to drain pipe 17 of tank 9 and to fill pipe 29 of tank 7 to dispense the remaining product in tank 9. The cleaning system 32 is then connected to valve 45 of storage tank 9 via line 34 and drain pipe 17 is connected to drain 21. Cleaning fluid is sprayed directly into tank 9 via nozzles 61 and is removed via drain pipe 17. After tank 9 is cleaned, the drain pipe is closed, line 34 is disconnected and tank 9 stands in a clean and empty condition awaiting refill by delivery truck 37. The filling and cleaning operations are repeated such that one supply tank is always available to supply syrup to mixing valve 19.

As is evident from the foregoing description, the delivery system of the invention allows for the precise delivery of a known quantity of syrup and eliminates waste due to over and under-filling. Valve 45 performs three functions: (1) it vents air, (2) it meters the amount of syrup delivered to the storage tank during fill-up operations and (3) it acts as a spray nozzle during cleaning. The multi-function valve 45 is also self cleaning. By supplying the truck with a quantity of syrup that is slightly less than the total amount of syrup to be delivered to all of the tanks, the truck's supply tank and hose will be empty after the last delivery such that syrup is not wasted. Moreover, because fill hose 39 is emptied after each delivery, it is much easier to carry and transport.

While the invention has been shown and described in some detail, it will be understood that this description and the accompanying drawings are offered merely by way of example and that the invention is to be limited in scope only by the appended claims.

What is claimed is:

1. A method for delivering syrup to a carbonated beverage system comprising the steps of:

(a) providing two syrup storage tanks each having a drain means, a fill means, and a means for dispensing syrup therefrom;

(b) dispensing syrup from one of the two syrup storage tanks from the means for dispensing syrup;

(c) rinsing the other of the two storage tanks with a cleaning solution through a multi-function valve in the tank;

(d) filling the other of the two storage tanks with syrup supply while venting air therefrom through the multi-function valve; and (e) automatically stopping the flow of syrup into the tank by preventing the flow of air through the multi-function valve when the syrup in the tank reaches a predetermined level.

2. The method according to claim 1, wherein the volume of said syrup supply is less than the total volume of all the storage tanks to be filled.

3. A delivery system for carbonated beverage syrup, comprising:

(a) a plurality of syrup storage tanks each having a drain means and a fill means, where one of said plurality of syrup storage tanks holds a quantity of syrup and another of said plurality of syrup storage tanks is substantially empty of syrup;

(b) means for dispensing syrup from one of said plurality of tanks holding a quantity of syrup;

(c) means for cleaning and filling the other of said plurality of syrup storage tanks including: (i) means for communicating said tank with a cleaning system to allow delivery of cleaning solution to said tank and for venting air from the tank while syrup is being delivered from said supply of syrup and for stopping the flow of syrup into the tank whereby a predetermined amount of syrup is delivered to said tank and (ii) means for communicating the tank with a supply of syrup to allow delivery of syrup to the tank.

4. The delivery system for carbonated beverages according to claim 3, wherein said means for cleaning and filling comprises a multi-function valve located in each of said plurality of storage tanks.

5. The delivery system for carbonated beverages according to claim 4, wherein said valve further includes spray nozzles for delivering cleaning solution through said valve to the interior of said tanks.

6. The delivery system for carbonated beverages according to claim 4, wherein said valve defines a passage between the interior and exterior of the tank such that air can be vented from the interior of the tank as the tank is filled with syrup and includes a means for closing the passage when a predetermined amount syrup has been delivered to the tank.

7. The delivery system for carbonated beverages according to claim 6, wherein said valve includes spray nozzles for delivering cleaning solution to the interior of said tanks said spray nozzles forming part of said passage.

8. The delivery system for carbonated beverages according to claim 6, wherein said means for closing the passage includes a seat formed in said valve and a ball cooperating with said seat, whereby the rising syrup level carries the ball to engage the seat.

9. The delivery system for carbonated beverages according to claim 3, wherein said means for communicating said other tanks with the supply of syrup includes a fill line.

10. The delivery system for carbonated beverages according to claim 9, further including means for conveying excess syrup from said supply line to said supply of syrup.

11. The delivery system for carbonated beverages according to claim 3, further including means for delivering cleaning solution to said tanks whereby one of said tanks can be cleaned while the other tank supplies syrup to said mixing means.

12. The delivery system for carbonated beverages according to claim 3, wherein said at least two storage tanks are stacked on top of one another.

13. A multi-function valve for use in a liquid storage tank comprising:

a) means defining a passage between the interior and exterior of the tank such that air can be vented from the interior of the tank as the tank is filled with liquid;

b) means for closing said passage when a predetermined amount of liquid has been delivered to the tank; and c) spray nozzles for delivering a cleaning liquid to the interior of the tank, said spray nozzles forming part of said passage.

14. The valve according to claim 13, wherein said means for closing the passage includes a seat formed in said means defining a passage and a floating ball cooperating with said seat whereby the rising syrup level causes the ball to engage the seat.

15. An automatic filling system for syrup tanks, comprising:

(a) a syrup storage tank having a drain and a fill pipe;

(b) means, including a fill line for communicating said tank fill pipe with a supply of syrup;

(c) valve means for venting air from the tank during filling, for stopping the flow of syrup into the tank when the tank is substantially full and for delivering cleaning solution to the tank when the tank is substantially empty comprising:

i) means defining a passage between the interior and exterior of the tank such that air can be vented from the tank as the tank is filled with syrup;

ii) means for closing said passage when a predetermined amount of syrup has been delivered to the tank; and iii) spray nozzles for delivering cleaning solution to the interior of the tank, said spray nozzles forming part of said passage.

16. The system according to claim 15, wherein said means for closing the passage includes a seat formed in an upper portion of said passage and a ball disposed in said passage, whereby the syrup entering said passage causes the ball to engage the seat.

17. The system according to claim 15, wherein said means for communicating said tank with a supply of syrup includes means for pressurizing the fill line to deliver syrup to said tank;

said means for closing said passage preventing venting when said tank is substantially full of syrup thereby to pressurize said tank;

whereby when the means for pressurizing the fill line is removed, the pressure in the tank causes reverse flow of syrup from the tank to the supply, thereby to evacuate syrup from the fill line.

18. A method for automatically filling a syrup tank comprising the steps of:

(a) providing a syrup storage tank having a drain and a fill pipe;

(b) communicating a supply of syrup through a fill line to said fill pipe;

(c) providing valve means for venting air from the tank during filling and for stopping the flow of syrup into the tank when said tank is substantially full;

(d) pressurizing the supply of syrup to deliver syrup to said tank;

(e) preventing venting when said tank is substantially full of syrup thereby to pressurize said tank and removing pressure in the fill line such that the pressure in the tank causes reverse flow of syrup from the tank to the supply thereby to evacuate the fill line of syrup.

* * * * *